US006994513B2

(12) United States Patent
Harris

(10) Patent No.: US 6,994,513 B2
(45) Date of Patent: Feb. 7, 2006

(54) VARIABLE WIDTH BACKHOE BUCKET

(76) Inventor: Richard Harris, 108 Arabian Trail, Spotsylvania, VA (US) 22553

( * ) Notice: Subject to any disclaimer, the term of this patent is extended or adjusted under 35 U.S.C. 154(b) by 64 days.

(21) Appl. No.: 10/699,792

(22) Filed: Nov. 4, 2003

(65) Prior Publication Data

US 2005/0095109 A1 May 5, 2005

(51) Int. Cl.
*E02F 9/00* (2006.01)

(52) U.S. Cl. ..... 414/722; 37/411

(58) Field of Classification Search ..... 414/722; 37/411, 430

See application file for complete search history.

(56) References Cited

U.S. PATENT DOCUMENTS 4,208,814 A 6/1980 Stone 5,918,390 A 7/1999 Ruff

FOREIGN PATENT DOCUMENTS

FR 0435796 7/1991

*Primary Examiner*—Donald W. Underwood
(74) *Attorney, Agent, or Firm*—Richard C. Litman

(57) ABSTRACT

A variable width backhoe bucket having a width that is reversibly adjustable between a minimum value and a maximum value, comprising: a middle shell, flanking first and second side shells, and a constrained guidance system. The middle shell has a curved bottom, first and second opposite sides, and first and second opposite ends. Each side shell defines a bottom and a side panel such that the side shells are in substantially mirror symmetry with respect to each other. The constrained guidance system comprises a plurality of elongated male members, a plurality of complementary elongated female members, and a first and second oppositely opposed hydraulic cylinders each with one opposite end attached to the middle shell and the other end attached to one of the two side shells for moving the side shells in and out relative to the middle shell.

9 Claims, 9 Drawing Sheets

VARIABLE WIDTH BACKHOE BUCKET

BACKGROUND OF THE INVENTION

1. Field of the Invention

The present invention relates to excavator buckets. More specifically, the invention is directed to a variable width backhoe bucket for earth digging machines. Still more specifically, the invention is directed to a variable width backhoe bucket for digging trenches of different widths without changing the backhoe bucket.

2. Description of the Related Art

A backhoe is the main tool found, for example, on a Caterpillar™ backhoe excavator. By way of analogy, the backhoe is an extremely powerful version of human arm or finger, and has three segments: a boom attached to a stick, which in turn is attached to a backhoe bucket; this arrangement is somewhat akin to the human arm which is made of three segments: an upper arm attached to a forearm, which in turn is attached to a hand. Three joints, comparable to a person's wrist, elbow and shoulder, connect the backhoe segments. The backhoe moves in a similar way to a person's arm but movement is driven by a hydraulic system rather than by dedicated muscles. In, for example, a Caterpillar™ backhoe, the boom is bent upward to make it easier to dig with obstacles in the way. This design also provides extra space for the backhoe bucket when the operator curls the backhoe bucket inwards with a full load.

The backhoe is used for various tasks such as digging trenches. The backhoe bucket is typically used to dig trenches of a specific width such as a two-foot (2') and three-foot (3') wide ditches. To dig a different width trench the conventional backhoe bucket is decoupled from the backhoe stick and swapped for another backhoe bucket with a different width. Swapping backhoe buckets is time consuming and lowers productivity. Thus, there is a need for a variable backhoe bucket that can be used to dig trenches of different width, such as two foot (2') and three foot (3') wide trenches, without requiring a change of bucket.

U.S. Pat. No. 5,918,390 issued Jul. 6, 1999 to Ruff, describes a bucket that consists of three shells, which are movable relative to each other and constrainedly guided towards each other. The width of the bucket is adjusted between a minimum value and a maximum value. At least two double scissors systems controllably adjust the width of the bucket. In at least one part of the '390 patent a hydraulic system is used to power the scissor system. Such scissors systems add complexity and maintain and may be prone to mechanical jamming. Thus, there is a need for an adjustable width backhoe bucket that is scissor system free.

U.S. Pat. No. 4,208,814 issued Jun. 24, 1980 to Stone, describes an extension device for an excavating bucket for increasing the cutting width and capacity of the bucket. The '814 device includes a container of generally the same cross-sectional configuration as the bucket and having attachment means for removably attaching the device on the side of the bucket and cutting edges and tines for cutting and tearing through the soil. The '814 device must be attached by an operator to the side of main excavating bucket and thereby having a deleterious impact on productivity. Specifically, working time is lost while attaching the '814 device to the main bucket. Thus, the '814 device explicitly does not solve the problem of digging variable width trenches without spending to change the digging configuration of the backhoe bucket.

European Pat. Doc. No. EP0435796 published 1991 Jul. 3 to Suau (FR), describes a bucket for an earth moving or excavation machine. The '796 bucket comprises a central section that comprises a curved bottom comprising, inside and outside metal sheets. The '796 bucket further comprises lateral sections which are substantially symmetrical with respect to a longitudinal median plane within the '796 bucket; each of the lateral sections comprises a curved lateral bottom having an inside lateral metal sheet and an outside lateral metal sheet that are joined together by two cross-pieces.

None of the above inventions and patents, taken either singly or in combination, is seen to describe the instant invention as claimed. Thus a variable width backhoe bucket solving the aforementioned problems is desired.

SUMMARY OF THE INVENTION

The variable width backhoe bucket having a width that is reversibly adjustable between a minimum value and a maximum value, comprising: a middle shell, flanking first and second side shells, and a constrained guidance system. The middle shell has a curved bottom, first and second opposite sides, and first and second opposite ends. Each side shell defines a bottom and a side panel such that the side shells are in substantially mirror symmetry with respect to each other. The constrained guidance system comprises a plurality of elongated male members, a plurality of complementary elongated female members, and a first and second oppositely opposed hydraulic cylinders each with one opposite end attached to the middle shell and the other end attached to one of the two side shells for moving the side shells in and out relative to the middle shell.

Accordingly, it is a principal object of the invention to provide a variable width backhoe bucket with a width that is controllably adjustable between a minimum value and a maximum value.

It is another object of the invention to provide a backhoe bucket that can dig trenches between about 18 inches and 3 feet in width without changing the backhoe bucket.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to excavator buckets. More specifically, the invention is directed to an adjustable variable width backhoe bucket for earth digging machines. Still more specifically, the invention is directed to a variable width backhoe bucket for digging trenches of differing widths without changing the backhoe bucket.

Figure 1:
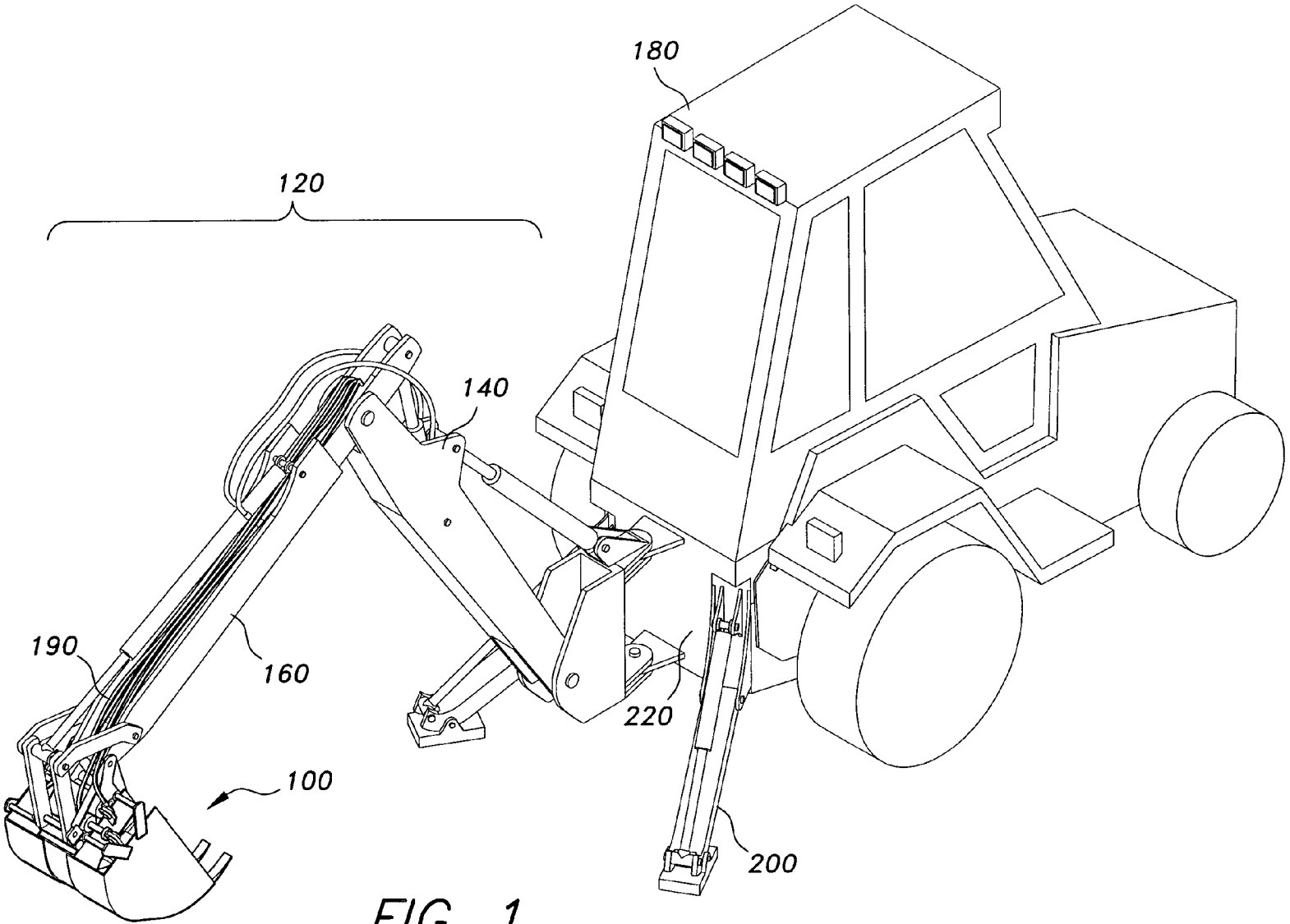
FIG. 1 is an environmental, perspective view of a variable width backhoe bucket according to the present invention.
Figure 2:
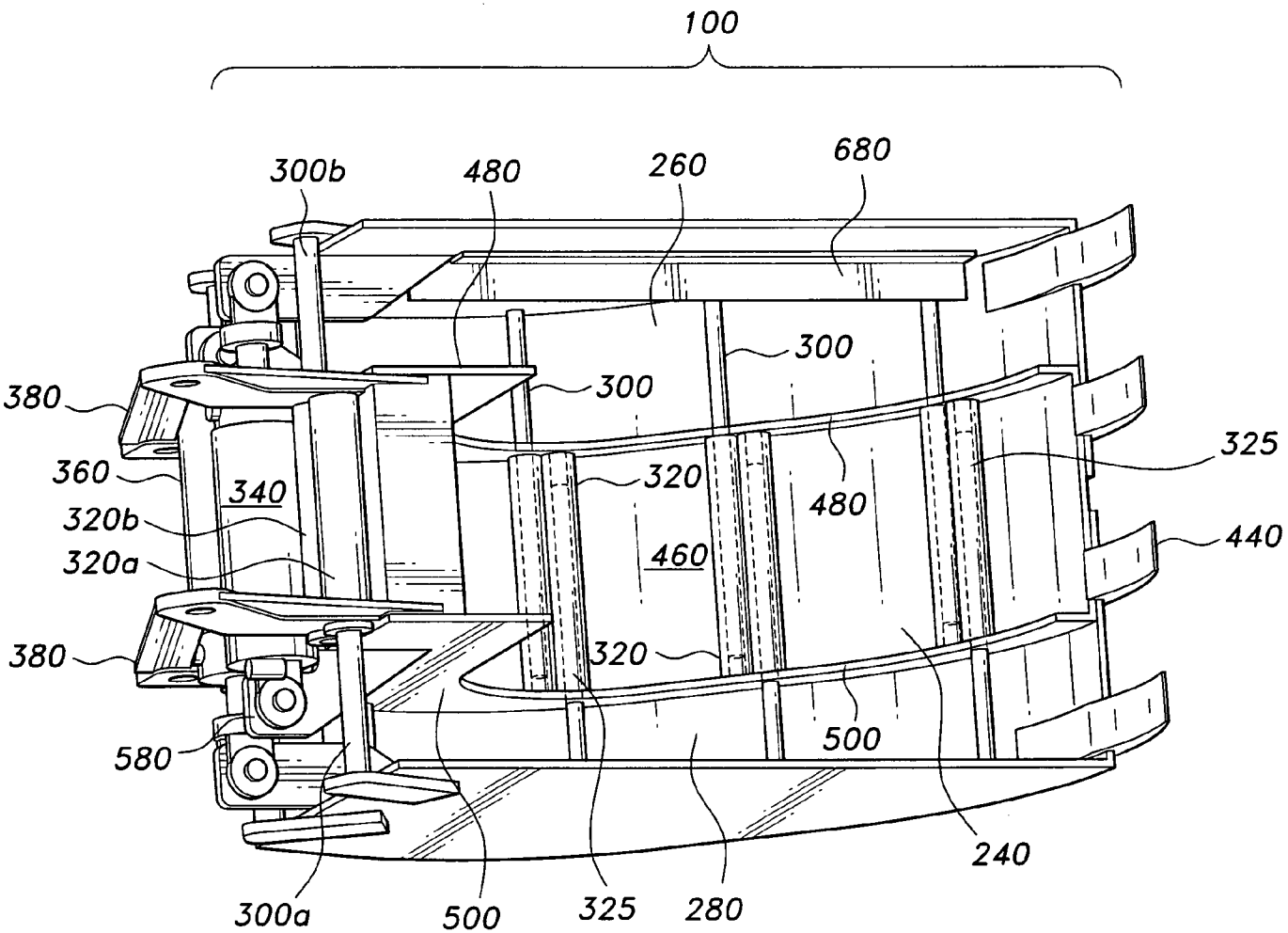
FIG. 2 is a perspective view of a variable width backhoe bucket according to the present invention.

FIG. 1 shows a perspective environmental view of a variable width backhoe bucket 100 according to the invention. The variable width backhoe bucket member 100 forms part of a backhoe 120, which also comprises a boom member 140 and a stick member 160. The backhoe 120 is shown attached to the rear end of a tractor or trench digger 180. Hydraulic pressure hoses 190 run along the backhoe 120. Stabilizers 200 are typically used to keep the rear end 220 of the tractor unit 180 stable when the backhoe 120 is in use.

Figure 5A:
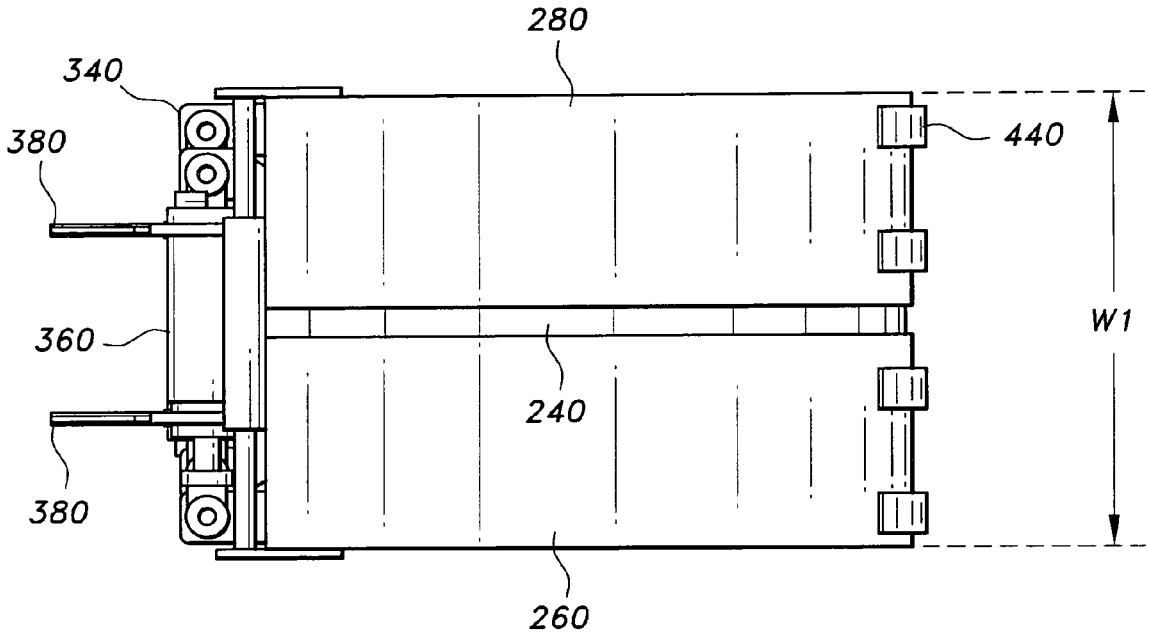
FIG. 5A is a bottom view of a variable width backhoe bucket according to the present invention.
Figure 5B:
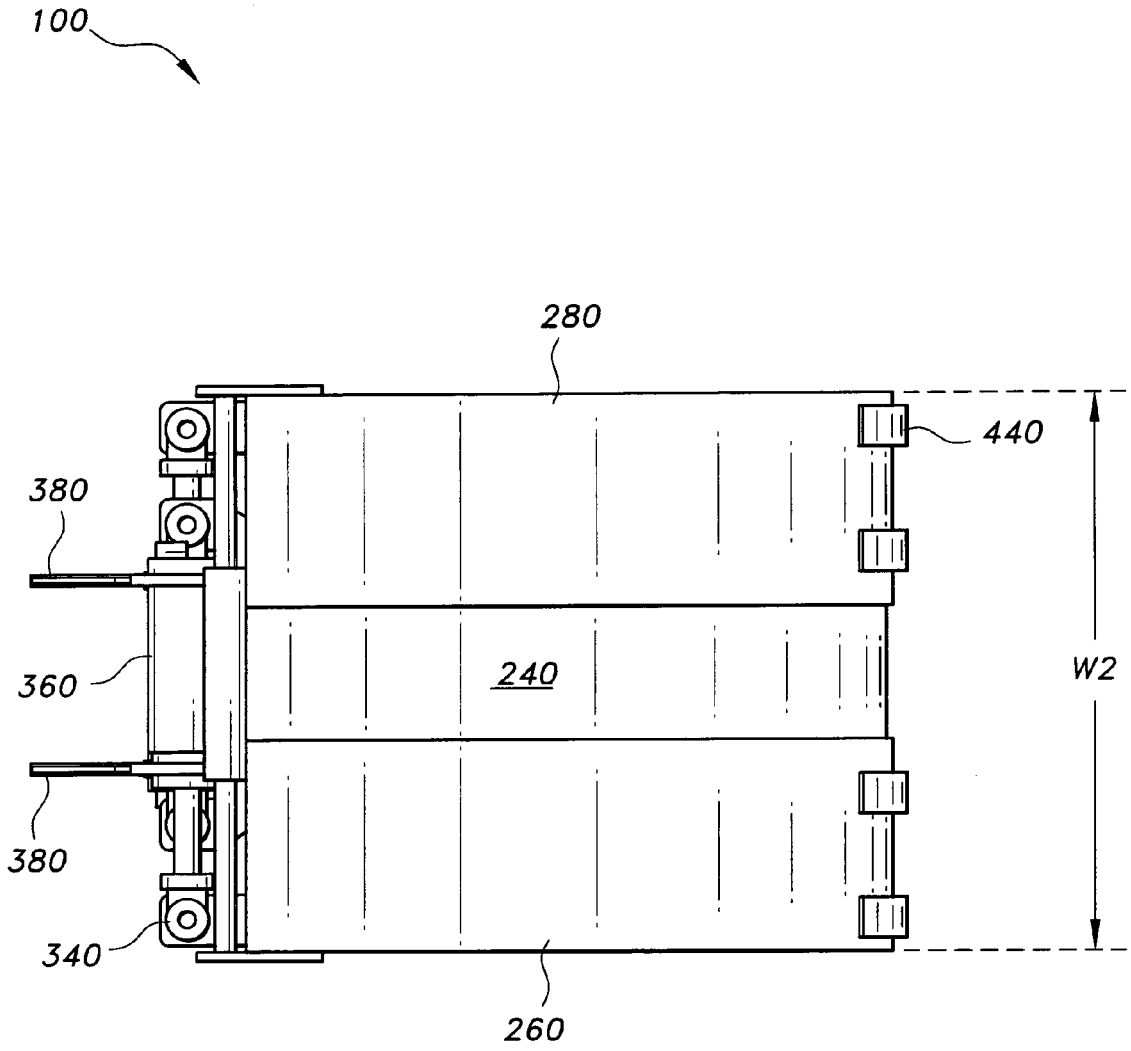
FIG. 5B is a bottom view of the variable width backhoe bucket of FIG. 5A with both side shells in an extended position relative to a central shell.
Figure 6A:
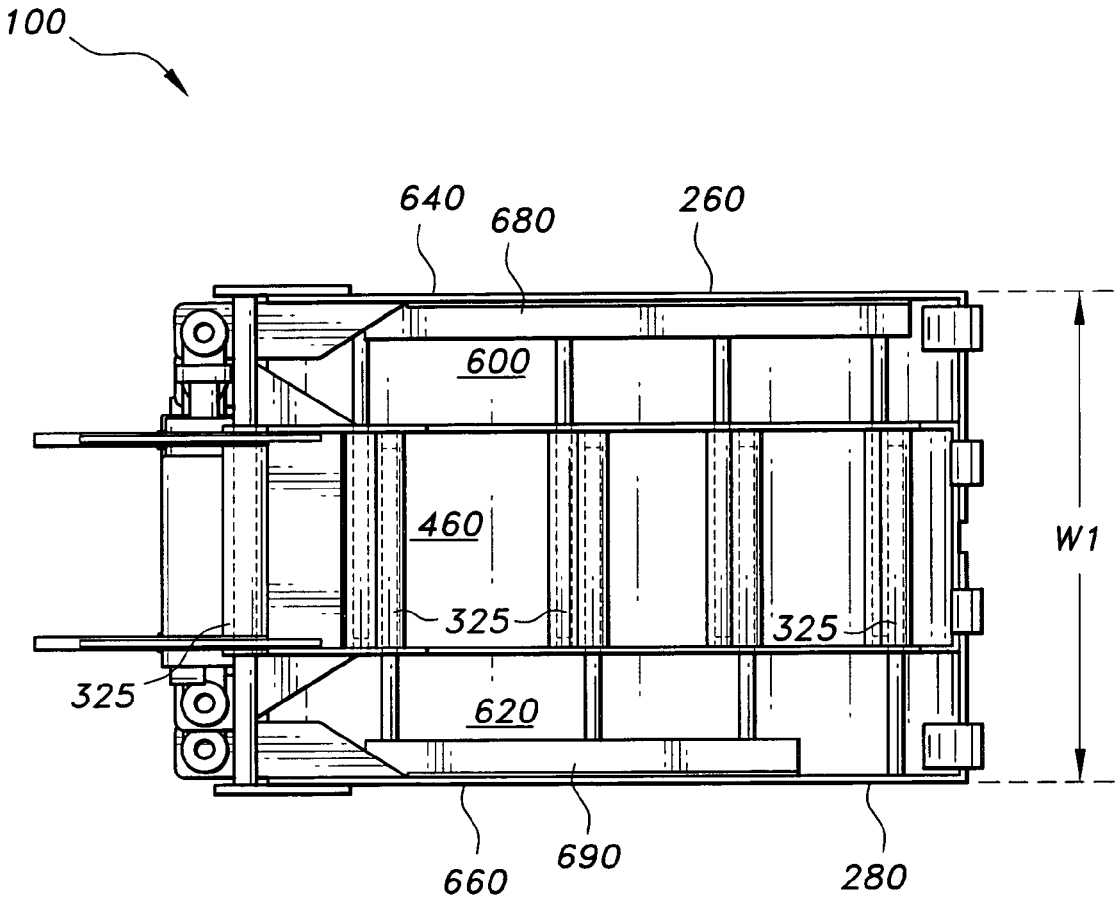
FIG. 6A is a top view of a variable width backhoe bucket according to the present invention.
Figure 6B:
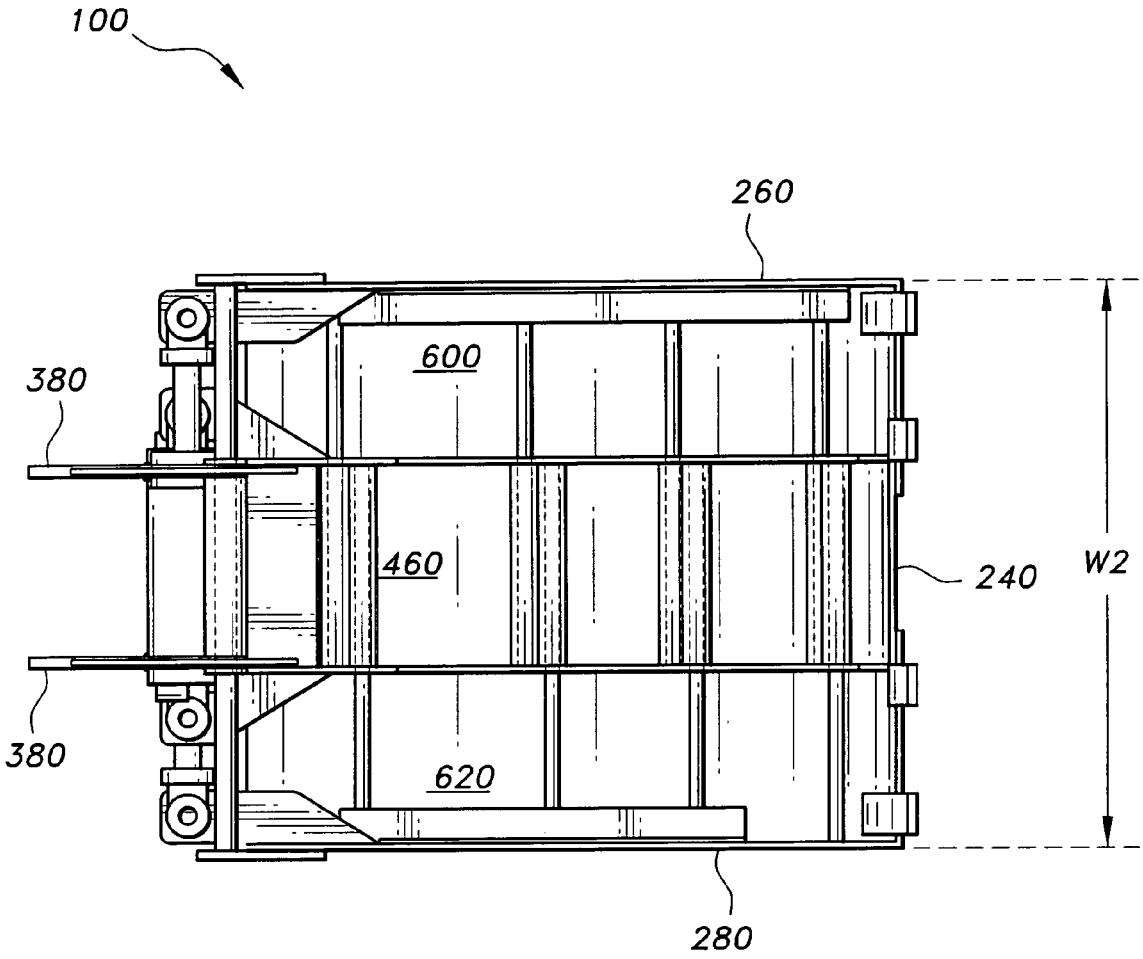
FIG. 6B is a top view of the variable width backhoe bucket of FIG. 6A with both side shells in an extended position relative to a central shell.

It should be understood that the variable width backhoe bucket 100 of the invention differs from a fixed width conventional backhoe bucket. The fixed width backhoe bucket is only suitable for digging a trench of a specific width. For example, a two-foot wide backhoe bucket can be used to dig a two-foot wide trench, but must be substituted for a three-foot wide backhoe bucket to dig a three-foot wide trench. In contrast, the variable width backhoe bucket 100 of the invention can dig a two-foot wide trench and a three-foot wide trench. Specifically, the backhoe bucket 100 of the invention is controllably adjustable in its width between a minimum value W1 (see FIGS. 5A and 6A) and a maximum value W2 (see FIGS. 5B and 6B). The preferred values of W1 and W2 are approximately eighteen inches and three feet, respectively. The most preferred values of W1 and W2 are approximately two feet and .three feet, respectively. The terms "controllably adjustable" and "reversibly adjustable" are hereinafter regarded as equivalent terms.

Referring to the figures in general, and FIGS. 2, 3A, 3B, and 4 in particular, the variable width backhoe 100 bucket comprises: a middle shell 240, flanking first 260 and second 280 side shells, and a constrained guidance system 290. The middle shell 240 has a curved bottom 460, first 480 and second 500 opposite sides, and first 520 and second 540 opposite ends (see FIG. 3A).

The side shells 260 and 280 each define a bottom 600 and 620, respectively, and side panels 640 and 660, respectively, such that the side shells 260 and 280 are in substantially mirror symmetry with respect to each other. The constrained guidance system 290 (see FIG. 3B) comprises a plurality of elongated male members 300, a plurality of complementary elongated female members 320, and a first 340 and second 360 oppositely opposed hydraulic cylinders each with one opposite end 400*a* and 420*a* (see FIG. 3A), respectively, attached to the middle shell 240 and the other end 400*b* and 420*b*, respectively, attached to one of the two side shells 260 and 280, respectively, for moving the side shells 260 and 280 in and out relative to the middle shell 240.

In more detail, the backhoe bucket 100 comprises a stationary middle shell 240 flanked by two side shells 260 and 280 that might be regarded as mirror images of each other and are controllably moved in and out relative to the middle shell 240 thereby reversibly adjusting the width of the backhoe bucket 100. The terms "central shell" and "middle shell" are hereinafter regarded as equivalent terms. The middle shell 240, and each side shell 260 and 280 are each preferably about one foot in width.

The outward and inward movement of the side shells 260 and 280 is constrainedly guided at the middle shell 240. The elongated male tubular sections 300 move in and out of the complementary female members 320 in response to the cooperative operation of at least one pair of horizontally opposed hydraulic cylinders 340 and 360 (see FIG. 4). The complementary male 300 and female members 320 can comprise a varying mix of such members such as complementary members 300*a*/320*a* and 300*b*/320*b* as shown in FIGS. 2, 3, 6A and 6B. The backhoe bucket 100 preferably comprises an attachment member 380 for attaching the bucket 100 to the stick member 160 of the backhoe 120.

The hydraulic cylinder 340 defines opposite ends 400*a* and 400*b*, and the cylinder member 360 defines opposite ends 420*a* and 420*b*. Cylinder ends 400*a* and 400*b* are attached to the middle shell 240 and the side shell 260, respectively. Cylinder ends 420*a* and 420*b* are attached to the side shell 280 and the middle shell 240, respectively. Any suitable type of hydraulic cylinders can be used providing the stroke of each cylinder is sufficient to reversibly push out the attached side shell 260 or 280 to reversibly adjust the width of the backhoe bucket 100 between about 18 inches and 3 feet, and more preferably between about 2 feet and 3 feet. The middle shell 240, and side shells 260 and 280 are each preferably about 1 foot in width. It should be understood that the term "reversibly adjust width" means the width can be controllably increased or decreased between a minimum (W1) and a maximum (W2) value.

Appropriate hydraulic pressure hoses 190 (FIG. 1) are attached to cylinders 340 and 360. While the cylinders 340 and 360 can be operated independently of each other it is preferred that they are operated in concurrent fashion to adjust the width of the backhoe bucket 100. The backhoe bucket 100 further comprises optional teeth 440.

The middle shell 240 comprises a curved bottom 460 defining opposite sides 480 and 500, and opposite ends 520 and 540. The opposite sides 480 and 500 optionally define projected edges 485 and 505, respectively. The attachment member 380 is shown attached to the opposite end 520. The female members 320 are attached to and traverses across the bottom 460 of the middle shell 240 as shown in, for example, FIG. 3A. Other female members such as 320*a* and 320*b* are attached to opposite end 520.

The female members 320 (and its derivatives 320*a* and 320*b*) are preferably of general tubular shape with substantially hollow bores 325 of circular cross section to respectively accommodate the male members 300 (and the male member derivatives 300*a* and 300*b*) which in turn are preferably of circular cross-section to complement the female member bores; however, the male members 300 and female members 320 might have a different cross-section such as a rectangular cross-section, polygon cross-section (i.e., with more than four sides), and oval cross-section.

At least one end of each female member 320 defines at least one opening 515 via which the male member 300 reversibly penetrates the female member 320 in response to hydraulic movements of the cylinders 340 and 360. The opposite sides 480 and 500, and more particularly projected edges 485 and 505, may be drilled to ensure access to the at least one opening 515 (see FIG. 3A) to enable insertion of the male members 300 into the female members 320 during assembly and manufacture of the backhoe bucket 100.

Figure 3A:
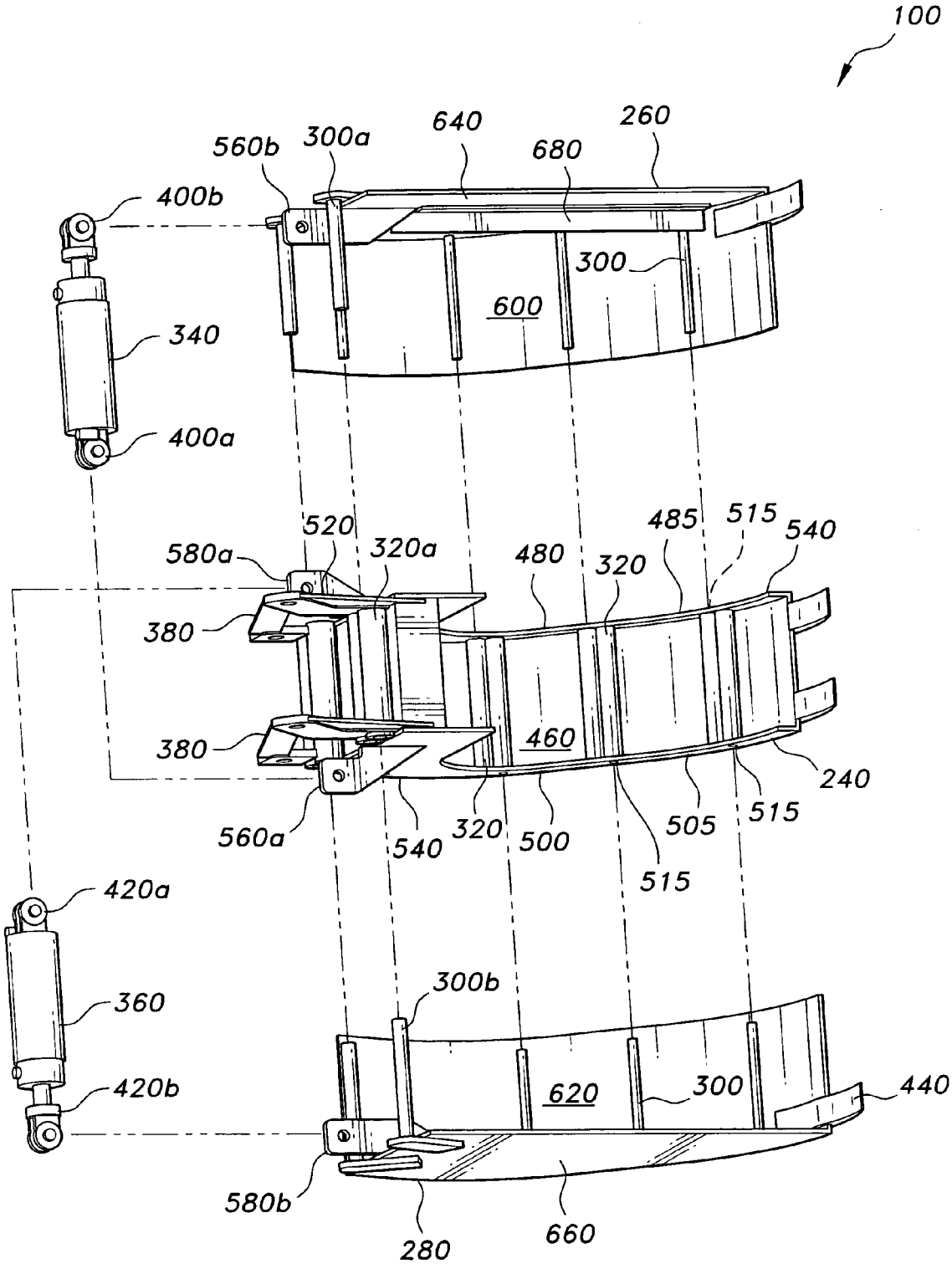
FIG. 3A is an exploded view of a variable width backhoe bucket according to the present invention.
Figure 3B:
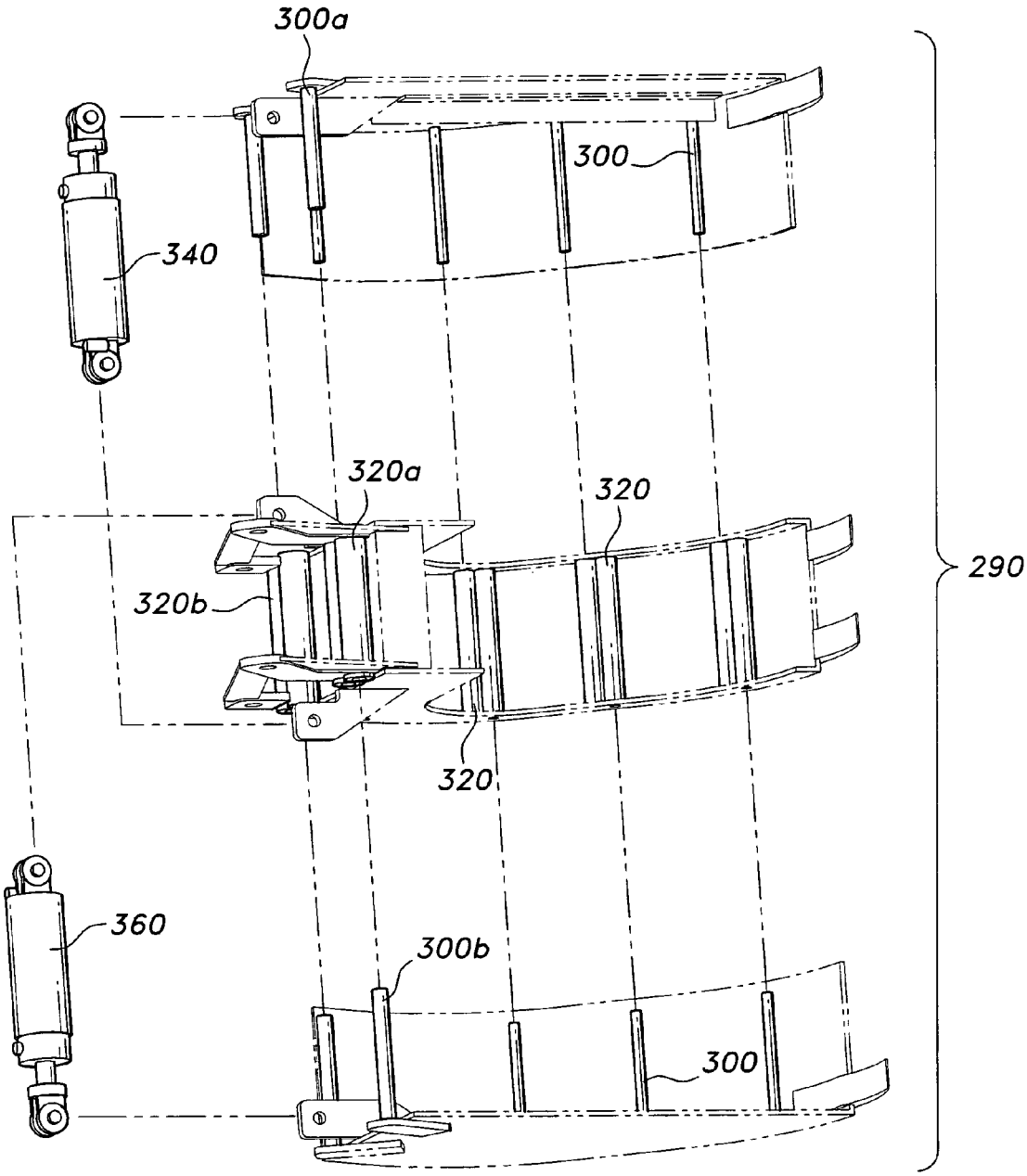
FIG. 3B is an exploded view of a constrained guidance system according to the present invention.
Figure 4:
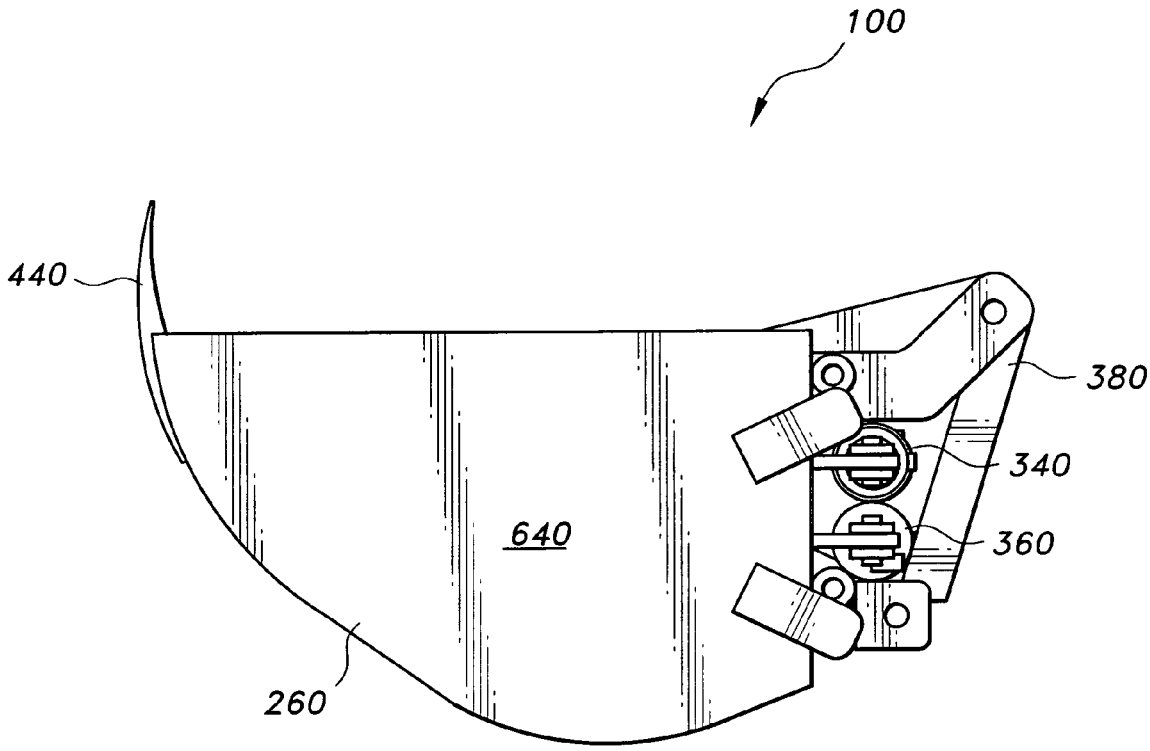
FIG. 4 is a side view of a variable width backhoe bucket according to the present invention.

The middle shell 240 further comprises reinforced anchor points 560*a* and 580*a* for securely holding the hydraulic cylinder ends 400*a* and 420*a*, respectively; reinforced anchor points 560*b* and 580*b* are located on the side sections 260 and 280 to attach to the cylinder ends 400*b* and 420*b*, respectively (see FIG. 3A). The middle shell 240, and side shells 260 and 280 are preferably made of high strength steel that is resistant to, for example, lateral torsion forces.

Side shells 260 and 280 have a curved lateral bottom 600 and 620, respectively, securely attached to a side panel 640 and 660, respectively. Optional reinforcement members 680 and 690 (see, e.g., FIG. 6A) are attached to the interior or exterior of the side panels 640 and 660, respectively; it should be understood that the reinforcement members 680 and 690 should be positioned to prevent interference with the mating of the male and female members 300 and 320, respectively. Specifically, the reinforcement members 680 and 690 help maintain the shape and integrity of each shell 260 and 280 thereby facilitating the male members 300 mating with the female members 320. The reinforcement members 680 and 690 may vary in length and may differ in length with respect to each other.

In normal operation at least part of each male member 300 remains inserted in its complementary female member 320. It should be understood that while the side shells 260 and 280 might be regarded as mirror images of each other they may differ without detracting from the spirit or scope of the present invention.

It is to be understood that the present invention is not limited to the embodiments described above, but encompasses any and all embodiments within the scope of the following claims.

I claim:

1. A variable width backhoe bucket, wherein the width of the backhoe bucket can be reversibly adjusted between a minimum value and a maximum value, comprising:

a middle shell having a curved bottom, first and second opposite sides, and first and second opposite ends, wherein the first opposite end is configured to attach to a stick section of a backhoe boom, a first side shell flanking the first opposite side of the middle shell, and a second side shell flanking the second opposite side of the middle shell, wherein each side shell defines a bottom and a side panel such that the side shells are in substantially mirror symmetry with respect to each other; and a constrained guidance system, comprising:

a plurality of elongated male members such that at least one elongated male member is attached to and traverses across the bottom of each side shell, a plurality of complementary elongated female members that are attached to and traverse across the bottom of the middle shell, wherein the elongated female members each comprise a bore configured to accommodate one of the plurality of elongated male members, and a first and second oppositely opposed hydraulic cylinders with opposite ends, one opposite end of the first and second cylinders respectively attached to the middle shell and the other opposite ends of the first and second cylinders respectively attached to the first and second side shells;

whereby the constrained guidance system reversibly moves the first and second side shells in and out relative to the middle shell thereby reversibly adjusting the width of the backhoe bucket.

2. The variable width backhoe bucket according to claim 1, wherein the middle shell, and each side shell are each about one foot in width.

3. The variable width backhoe bucket according to claim 1, wherein each side shell is fitted with a reinforcement member.

4. The variable width backhoe bucket according to claim 1 further comprising an attachment member attached to the first end of the middle shell, wherein the attachment member is configured to enable attachment of the backhoe bucket to a stick section of a backhoe.

5. The variable width backhoe bucket according to claim 1, wherein the male and female members are of generally tubular shape.

6. The variable width backhoe bucket according to claim 1, wherein the male and female members have an overall rectangular cross-section.

7. The variable width backhoe bucket according to claim 1, wherein the male and female members have an overall polygon cross-section.

8. The variable width backhoe bucket according to claim 1, wherein the constrained guidance system controllably adjusts the width of the backhoe bucket from about eighteen inches to about three feet.

9. The variable width backhoe bucket according to claim 1, wherein the constrained guidance system controllably adjusts the width of the backhoe bucket from about two feet to about three feet.

* * * * *